US008517209B2

(12) United States Patent
Finell

(10) Patent No.: US 8,517,209 B2
(45) Date of Patent: Aug. 27, 2013

(54) CONTAINER WRAP AND CONTAINER ASSEMBLY

(75) Inventor: Rebecca M. Finell, Tempe, AZ (US)

(73) Assignee: BKD Acquisition, Inc., Oak Brook, IL (US)

( * ) Notice: Subject to any disclaimer, the term of this patent is extended or adjusted under 35 U.S.C. 154(b) by 927 days.

(21) Appl. No.: 12/508,205

(22) Filed: Jul. 23, 2009

(65) Prior Publication Data

US 2011/0017756 A1 Jan. 27, 2011

(51) Int. Cl.
*B65D 25/36* (2006.01)

(52) U.S. Cl.
USPC ..... 220/732

(58) Field of Classification Search
USPC ..... 220/732, 737, 23.86, 23.87, 694, 220/574, 495.01, 495.03; 206/223, 829; 248/205.5, 206.2, 346.11; 53/461
See application file for complete search history.

(56) References Cited

U.S. PATENT DOCUMENTS

| | | | | |
|---|---|---|---|---|
| 3,018,015 | A | 1/1962 | Agriss et al. | |
| 3,575,781 | A | 4/1971 | Pezely | |
| 3,770,115 | A * | 11/1973 | Cannell | 206/508 |
| D358,091 | S * | 5/1995 | Warburton | D9/429 |
| D439,160 | S * | 3/2001 | Abayhan et al. | D9/429 |
| 6,589,891 | B1 | 7/2003 | Rast | |
| 6,672,622 | B2 | 1/2004 | Barron | |
| 7,063,231 | B2 | 6/2006 | Stanos et al. | |
| 2001/0045188 | A1 | 11/2001 | Tsengas | |
| 2009/0078712 | A1 * | 3/2009 | Zimmerman | 220/636 |

* cited by examiner

*Primary Examiner* — Mickey Yu
*Assistant Examiner* — Allan Stevens
(74) *Attorney, Agent, or Firm* — Michael Best & Friedrich LLP

(57) ABSTRACT

A device to prevent breakage of a breakable container formed with an outer face and an opposed an inner face that meet at a parametric edge encircling an opening to the inner face of the breakable container. The device includes a container wrap formed of a shock resistant material. The container wrap is constructed to be applied over and across the outer face and the parametric edge of the breakable container to absorb and dissipate impacting forces to prevent breakage of the breakable container. At least one suction cup is formed in the container wrap to detachably secure the container wrap to a surface.

24 Claims, 9 Drawing Sheets

CONTAINER WRAP AND CONTAINER ASSEMBLY

FIELD OF THE INVENTION

The present invention relates to breakable containers.

More particularly, the present invention relates to breakable dishware.

In a further and more specific aspect, the present invention relates to container wraps used to prevent the unnecessary breakage of breakable dishware during normal use.

BACKGROUND OF THE INVENTION

Dishware is the general term for dishes used in serving and eating food, including plates and bowls. For various reasons, dishware used to feed babies and young children is normally formed of plastic. However, the plastic material used to construct plastic dishware can leach harmful chemicals that can lead or contribute to health and developmental problems in babies and young children. As such, parents of young children are becoming concerned about using plastic dishware for feeding their kids. As a result, some parents use breakable dishes and bowls made from glass, earthenware, or the like, which do not leach harmful chemicals and which do not cause health problems. However, breakable dishes and bowls are dangerous because the easily break forming sharp fragments that can cut children's hands and feet. Accordingly, there is a need to eliminate usage of harmful plastic dishware in favor of safe breakable dishware made of earthenware, glass, and the like, and need to prevent the unnecessary breakage of breakable dishware.

SUMMARY OF THE INVENTION

According to the principle of the invention, a container assembly includes a breakable container and a container wrap. The breakable container has an outer face and an opposed an inner face that meet at a parametric edge encircling a container opening to the inner face of the breakable container. The inner face of the breakable container is recessed with respect to the parametric edge and the container opening and is to receive and hold food for eating, or other material. The breakable container is made of earthenware, stoneware, porcelain, glass, or other like or similar breakable material. The container is exemplary of a bowl in a preferred embodiment, and can be formed in the shape of a plate or other like or similar container having substantially common structural characteristics. The container wrap is applied over and across the outer face and the parametric edge of the breakable container, and the container wrap is formed of a shock resistant material to absorb and dissipate impacting forces to prevent breakage of the breakable container. At least one suction cup is formed in the container wrap to detachably secure through suction the container wrap, and the breakable container, to a surface. The inner face of the breakable container is unobstructed by the container wrap to permit use of the inner face of the breakable container without obstruction or interference by the container wrap. The shock resistant material of the container wrap is flexible and stretchable, and the container wrap flexibly and stretchably conforms to the outer surface and the parametric edge of the breakable container. Numerous shock resistant protuberances formed in the shock resistant material of the container wrap extending across and projecting outward with respect to the outer face and the parametric edge of the breakable container. An openwork of the shock resistant material is formed in the container wrap. The openwork contains numerous openings across the outer face and the parametric edge of the breakable container, and is formed with the protuberances. The openings are arranged in spaced apart continuous rows of the openings parallel with respect to the parametric edge of the breakable container. In a particular embodiment, the openings of each of the continuous rows of the openings are substantially equal in size, and are substantially equally spaced apart. The protuberances are arranged in spaced apart continuous rows of the protuberances parallel with respect to the parametric edge of the breakable container and the continuous rows of the openings. In a particular embodiment, the protuberances of each of the continuous rows of the protuberances are substantially equal in size, and are substantially equally spaced apart.

According to the principle of the invention, provided is a device to prevent breakage of a breakable container formed with an outer face and an opposed an inner face that meet at a parametric edge encircling a container opening to the inner face of the breakable container, the inner face of the breakable container being recessed with respect to the parametric edge and the container opening. According to the principle of the invention, the device consists of a container wrap formed of a shock resistant material. The container wrap is constructed to be applied over and across the outer face and the parametric edge of the breakable container to absorb and dissipate impacting forces to prevent breakage of the breakable container. At least one suction cup is formed in the container wrap to detachably secure the container wrap to a surface. The shock resistant material is flexible and stretchable to permit the container wrap to be flexibly and stretchably applied to the outer surface and the parametric edge of the breakable container. Numerous shock resistant protuberances are formed in the shock resistant material to project outward with respect to the outer face and the parametric edge of the breakable container. An openwork of the shock resistant material is formed in the container wrap. The openwork contains numerous openings to extend across the outer face and the parametric edge of the breakable container and formed with the protuberances. The openings are arranged in spaced apart continuous parallel rows of the openings. In a particular embodiment, the openings of each of the continuous parallel rows of the openings are substantially equal in size, and are substantially equally spaced apart. The protuberances are arranged in spaced apart continuous parallel rows of the protuberances parallel with respect to the continuous parallel rows of the openings. In a particular embodiment, the protuberances of each of the continuous parallel rows of the protuberances are substantially equal in size and are substantially equally spaced apart.

According to the principle of the invention, a method includes providing a breakable container formed with an outer face and an opposed an inner face that meet at a parametric edge encircling a container opening to the inner face, the inner face of the breakable container being recessed with respect to the parametric edge and the container opening, providing a container wrap formed of a shock resistant material, and applying the container wrap over and across the outer face and the parametric edge of the breakable container leaving the inner face of the breakable container unobstructed by the container wrap to permit use of the inner face of the breakable container without obstruction or interference by the container wrap. The shock resistant material of the container wrap is flexible and stretchable, and the step of applying the container wrap over and across the outer surface and the parametric edge of the breakable container further includes flexing and stretching the container wrap over and across the outer surface and the parametric edge of the breakable container. The method next includes detachably securing the container wrap to a surface to detachably secure the breakable container with respect to the surface. The step of detachably securing the container wrap to the surface to detachably secure the breakable container with respect to the surface includes providing the container wrap with at least one suction cup, and applying the suction cup to the surface.

BRIEF DESCRIPTION OF THE DRAWINGS

Referring to the drawings.

DETAILED DESCRIPTION OF PREFERRED EMBODIMENTS

Figure 1:
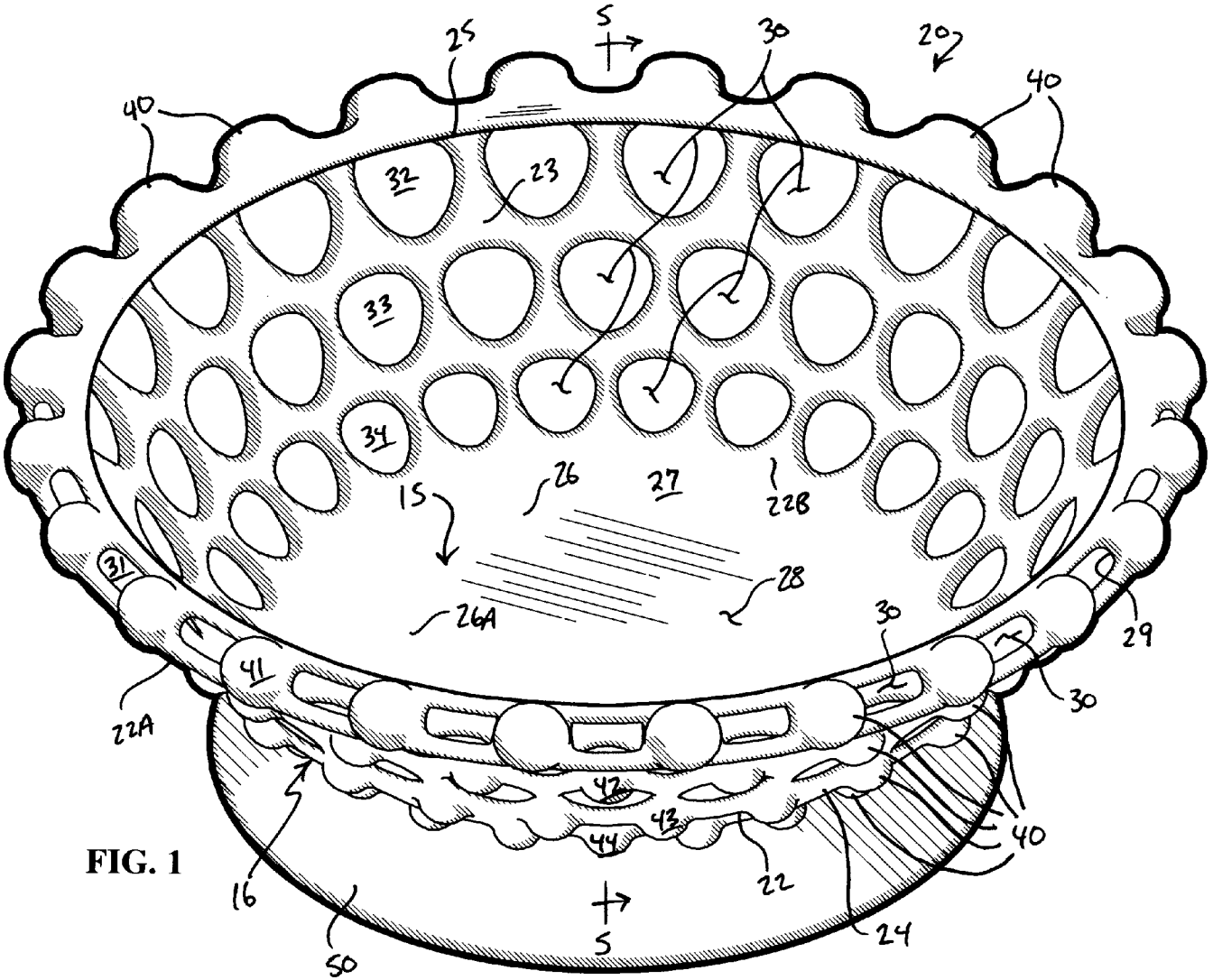
FIG. 1 is a perspective view of a container wrap constructed and arranged in accordance with the principle of the invention.
Figure 2:
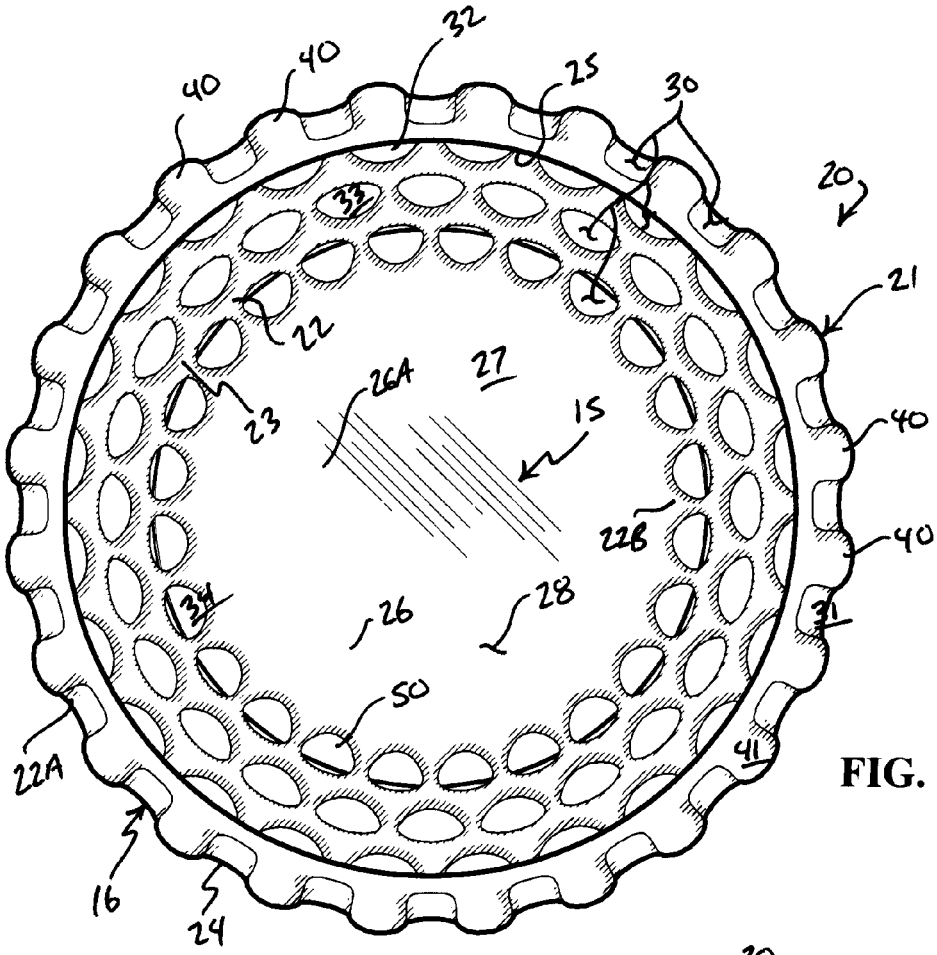
FIG. 2 is a top plan view of the container wrap of FIG. 1.
Figure 3:
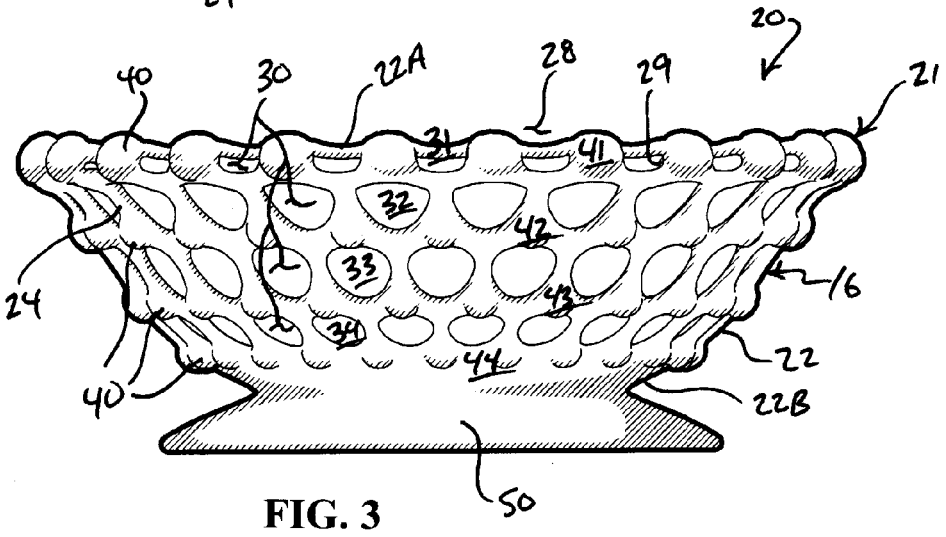
FIG. 3 is a side elevation view of the container wrap of FIG. 1.
Figure 4:
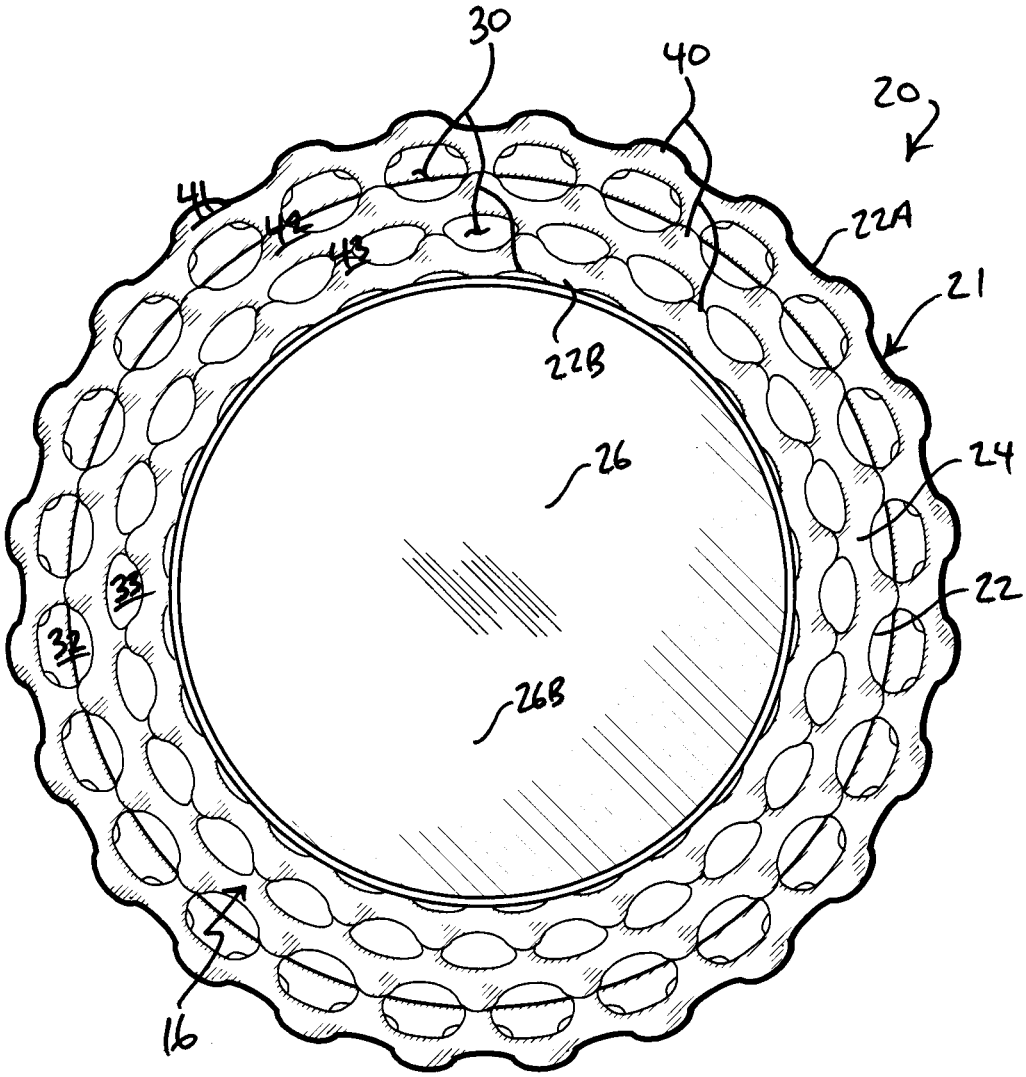
FIG. 4 is a bottom plan view of the container wrap of FIG. 1.

Turning now to the drawings, in which like reference characters indicate corresponding elements throughout the several views, attention is directed to FIGS. 1-7 in which there is seen various views of a container wrap 20 constructed and arranged in accordance with the principle of the invention, and that in use is applied to a breakable container to prevent breakage of the breakable container, and yet which leaves breakable container available to be used in accordance with its intended or normal use without obstruction or interference. Container wrap 20 is formed of a tough, flexible, stretchable, and shock or impact resistant material, and is preferably integrally formed, such as through molding, but may be formed of a plurality of parts attached by heat bonding, adhesive, or the like. A preferred material exhibiting the foregoing beneficial properties is polyurethane plastic, and silicone rubber or other rubber or elastomeric material or other like or similar material or combination of materials having the properties of toughness, flexibility, stretchability, and shock or impact resistance can be used without departing from the invention, such as rubber.

Referencing FIGS. 1-7 in relevant part, container wrap 20 includes an openwork or mesh 21 of the above-referenced shock or impact resistant material. Openwork 21 is formed in a sidewall 22 of container wrap 20. Openwork 21 is a web or web-like structure and has numerous openings formed through its substance forming ribs or strands in sidewall 22 around and between the numerous openings, and that also numerous protuberances formed in its substance, the substance of openwork 21 consisting of the shock resistant material forming sidewall 22. Sidewall 22 includes opposed upper and lower ends denoted generally at 22A and 22B, and opposed inner and outer surfaces 23 and 24, which extend between a parametric edge 25 formed in upper end 22A and an opposed bottom 26 formed in lower end 22B of sidewall 22. Bottom 26 is preferably integral with lower end 22B of sidewall 22. Bottom 26 of container wrap 20 is broad, and is circular in shape in the present embodiment, and has opposed inner and outer surfaces 26A and 26B best referenced in FIGS. 5, 7, and 10. Inner surface 26A of bottom 26 is contiguous with inner surface 23 of sidewall 22, and inner surface 26A of bottom and inner face 23 of sidewall 22 cooperate to form an inner face of container wrap 20 denoted generally at 15. Outer surface 26B of bottom 26 is contiguous with outer surface 24 of sidewall 22, and outer surface 26B of bottom 26 and outer surface 24 of sidewall 22 cooperate to form an outer face of container wrap 20 denoted generally at 16.

Referencing FIGS. 1, 2, 5, and 7, parametric edge 25 and opposed bottom 26, and sidewall 22 extending between parametric edge 25 and opposed bottom 26 cooperate to form a rounded, substantially bowl-shaped structure that tapers or otherwise narrows inwardly from upper end 22A of continuous sidewall 22 to lower end 22B of continuous sidewall 22 at bottom 26 as illustrated, in which inner face 15 of container wrap 20, formed by the cooperation of inner surface 23 of sidewall 22 and inner surface 26A of bottom 26, is substantially concave in shape and forms a depression or receiving area 27, and parametric edge 25 at upper end 22A encircles an opening 28 above receiving area 27 which leads to receiving area 27. Parametric edge 25 is in-turned toward or otherwise with respect to inner face 15, including inner surface 23 of sidewall 22 and inner surface 26A of bottom 26, forming a groove 29 in inner surface 23 of sidewall 22 in upper end 22A of sidewall 22 as denoted in FIGS. 1, 3, and 5-10. Groove 29 is directed inwardly toward inner face 15 of container wrap 20, including inner surface 23 of sidewall 22 and inner surface 26B of bottom 26, and encircles opening 28 to depression or receiving area 27.

As illustrated in FIGS. 1-8, sidewall 22 is formed with numerous openings 30 through its substance to form openwork 21, and numerous protuberances 40. Protuberances 40 are shock resistant. Openings 30 and protuberances 40 openwork 21 cooperate to absorb and dissipate impacting forces to prevent breakage of a breakable container held by container wrap 20, in accordance with the principle of the invention, and this will be explained more fully later in this specification.

Openings 30 extend through sidewall 22 from inner surface 23 to outer surface 24 as best referenced in FIGS. 1-3, and 5-7. Openings 30 are formed in sidewall 22 from and between upper end 22A and lower end 22B of sidewall 22. Openings 30 form openwork 21 of container wrap 20, which structurally characterizes mesh or openwork 21 as a latticelike structure having openings, namely, openings 30, through the substance of sidewall 22.

In the present embodiment, container wrap 20 is formed with ninety-six openings 30, and this number of openings 30, being numerous openings 30 as such, is set forth simply as a matter of example with the understanding that less or more openings 30 may be used consistent with the teachings of the present invention so as to form an openwork in container wrap 20, namely, openwork 21. Openings 30 are arranged in a pattern across the extent of sidewall 22, and the ensuing discussion explains the various aspects of the pattern of openings 30.

Openings 30 are substantially uniformly arranged across the extent of sidewall 22 to form the latticelike structure exemplary of openwork 21. Openings 30 are arranged in rows 31, 32, 33, and 34, referenced in FIGS. 1-8. Rows 31-34 are each circular and are thus continuous, and encircle depression or receiving area 27. Rows 31-34 are also parallel with respect to each other in the present embodiment, and are parallel with respect to upper and lower ends 22A and 22B of sidewall 22. Row 31 is formed at upper end 22A of sidewall 22 at groove 29 (groove 29 is denoted in FIGS. 1, 3, and 5-10) and thus also encircles opening 28, row 34 is formed at lower end 22B of sidewall 22 proximate to bottom 26, and rows 32 and 33 are formed between rows 31 and 34, as illustrated.

Openings 30 of row 31 are substantially equal in size and shape and are substantially equally spaced apart, openings 30 of row 32 are substantially equal in size and shape and are substantially equally spaced apart, openings 30 of row 33 are substantially equal in size and shape and are substantially equally spaced apart, and openings 30 of row 34 are substantially equal in size and shape and are substantially equally spaced apart. In the present embodiment, there are twenty-four openings 30 in each of rows 31, 32, 33, and 34, and the size of openings 30 is progressively smaller from row 32 to row 34 due to the taper of sidewall 22 from upper end 22A to lower end 22B in order to fit twenty-four openings 30 in each of rows 32, 33, and 34. Openings 30 of each row of openings 30 are offset with respect to the openings 30 of each adjacent row of openings 30. Furthermore, rows 31-34 of openings 30 are each considered a field of openings 30.

Referencing FIGS. 1-8, protuberances 40 are formed in sidewall 22 from and between upper end 22A and lower end 22B, and are formed in outer surface 24 of sidewall 22 and project outward from outer surface 24 of sidewall 22. In the present embodiment, container wrap 20 is formed with ninety-six, spaced-apart protuberances 40, and this number of protuberances 40, being numerous protuberances 40 as such, is set forth simply as a matter of example with the understanding that less or more protuberances 40 may be used consistent with the teachings of the present invention.

Protuberances 40 are arranged in a pattern across the extent of sidewall 22, and the ensuing discussion explains the various aspects of the pattern of protuberances 40. Protuberances 40 are substantially uniformly arranged across the extent sidewall 22. Protuberances 40 are arrange in rows 41, 42, 43, and 44, referenced in FIGS. 1-8. Rows 41-44 are each circular and thus continuous and encircle depression or receiving area 27. Rows 41-44 are parallel with respect to each other, and are parallel with respect to each of rows 31, 32, 33, and 34 of openings 30. Rows 41-44 are further parallel with respect to upper and lower ends 22A and 22B of sidewall 22. Row 41 is formed at upper end 22A of sidewall 22 opposite to groove 29 (groove 29 is denoted in FIGS. 1, 3, and 5-10) and thus also encircles opening 28, row 44 is formed at lower end 22B of sidewall 22 proximate to bottom 26, and rows 42 and 43 are formed between rows 41 and 44, as illustrated. Rows 41-44 of openings protuberances 40 are each considered a field of protuberances 40.

Consistent with this disclosure, any pattern of openings 30 and any pattern of protuberances 40 can be used in container wrap 20 without departing from the invention. Moreover, openings 30 can be randomly arranged, protuberances 40 can be randomly arranged, openings 30 can be of varying size and shape, and protuberances 40 can be of varying size and shape, if so desired.

Row 31 of openings 30 runs concurrently with respect to row 41 of protuberances 40, and each protuberance 40 of row 41 is formed between a pair of opposed openings 30. As such, row 31 of openings and row 41 of protuberances 40 cooperate to form a row of alternating openings 30 and protuberances 40. Rows 32-34 of openings 30 and rows 42-44 alternate along sidewall 22 between upper end 22A of sidewall 22 and lower end 22B of sidewall 22 thereby forming alternating rows or fields of openings 30 and protuberances 40 along sidewall between upper end 22A of sidewall 22 and lower end 22B of sidewall 22. In characterizing the alternating rows of openings 30 and protuberances 40 formed in sidewall 22, row 42 of protuberances 40 is formed substantially between rows 32 and 33 of openings 30, row 43 of protuberances 40 is formed substantially between rows 33 and 34 of openings 30, and row 44 of protuberances 40 is formed at lower end 22B of sidewall 22 between row 34 of openings 30 and a suction cup 50 formed in bottom 26, which will be discussed presently.

Figure 5:
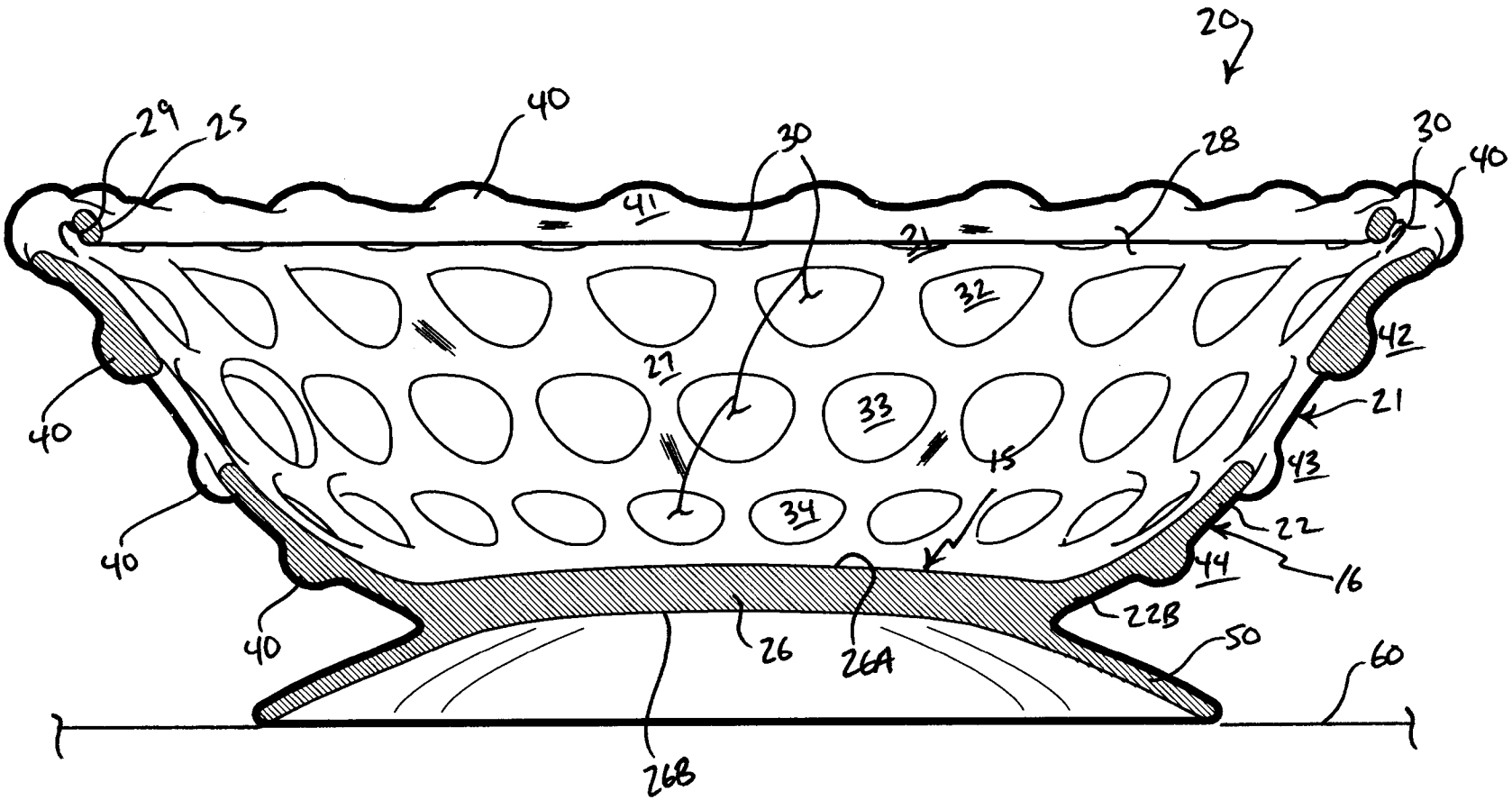
FIG. 5 is a sectional view taken along line 5-5 of FIG. 1.
Figure 6:
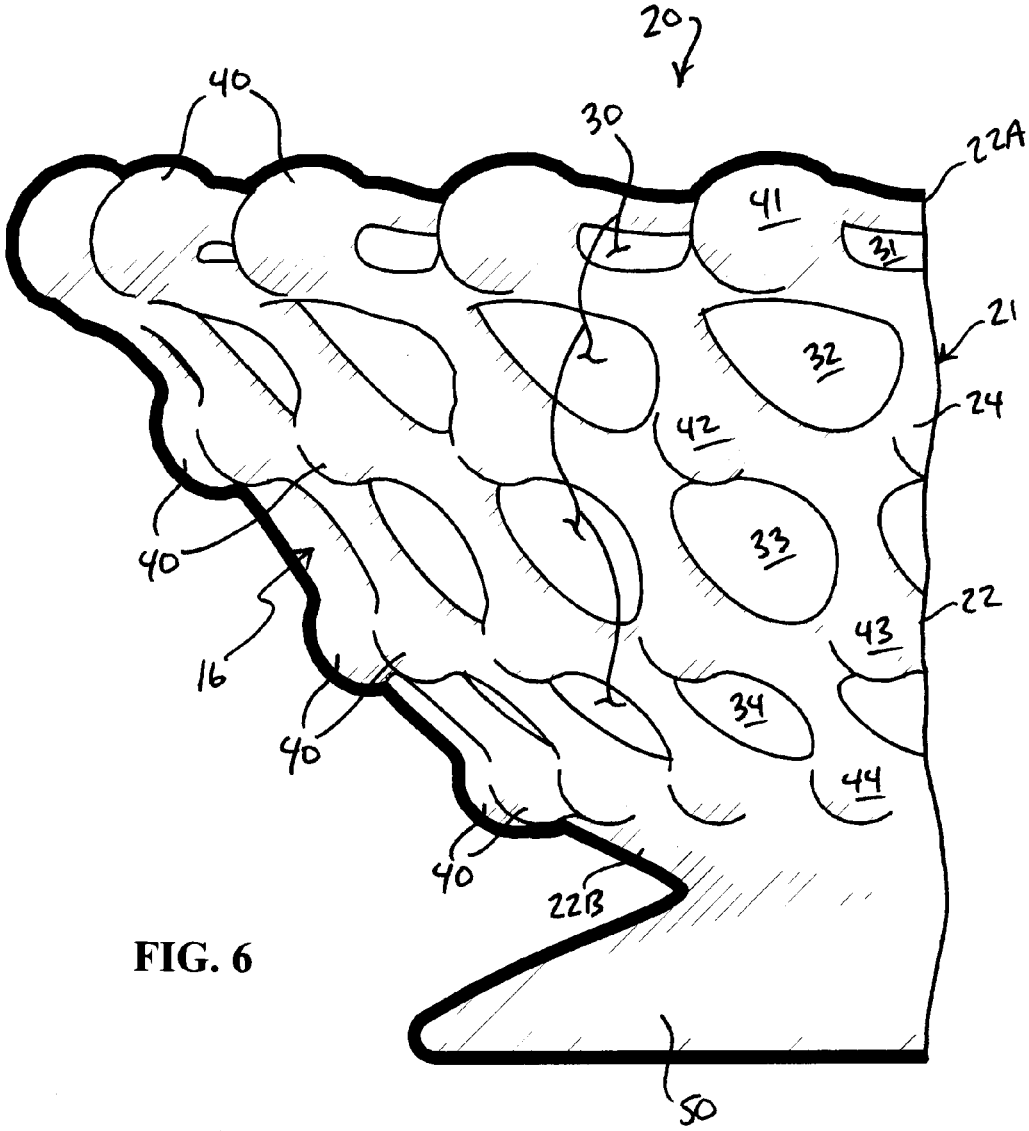
FIG. 6 is an enlarged, fragmented side elevation view of the container wrap of FIG. 1.
Figure 7:
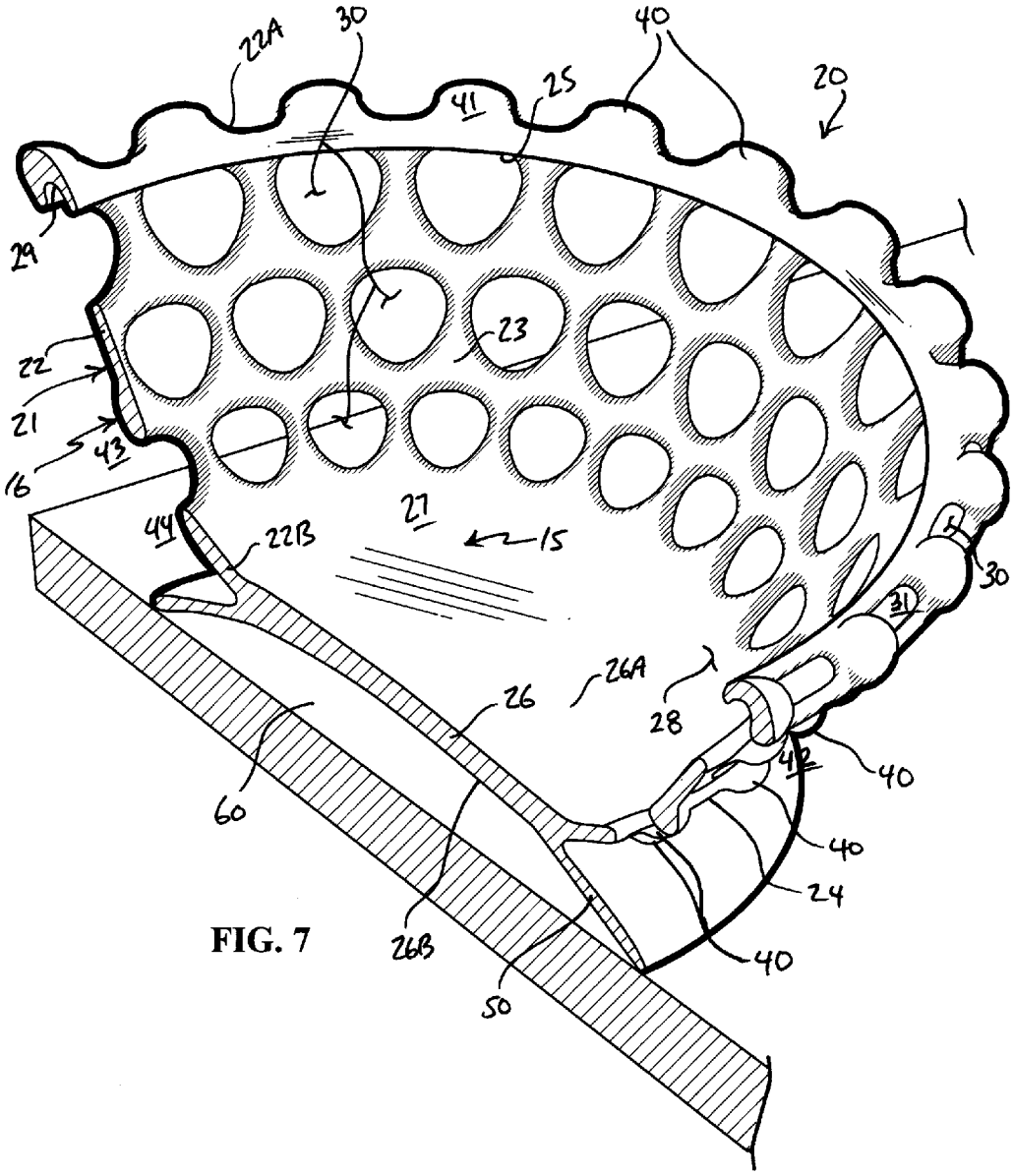
FIG. 7 is a perspective sectional view illustrating the container wrap of FIG. 1 applied to a support surface.
Figure 10:
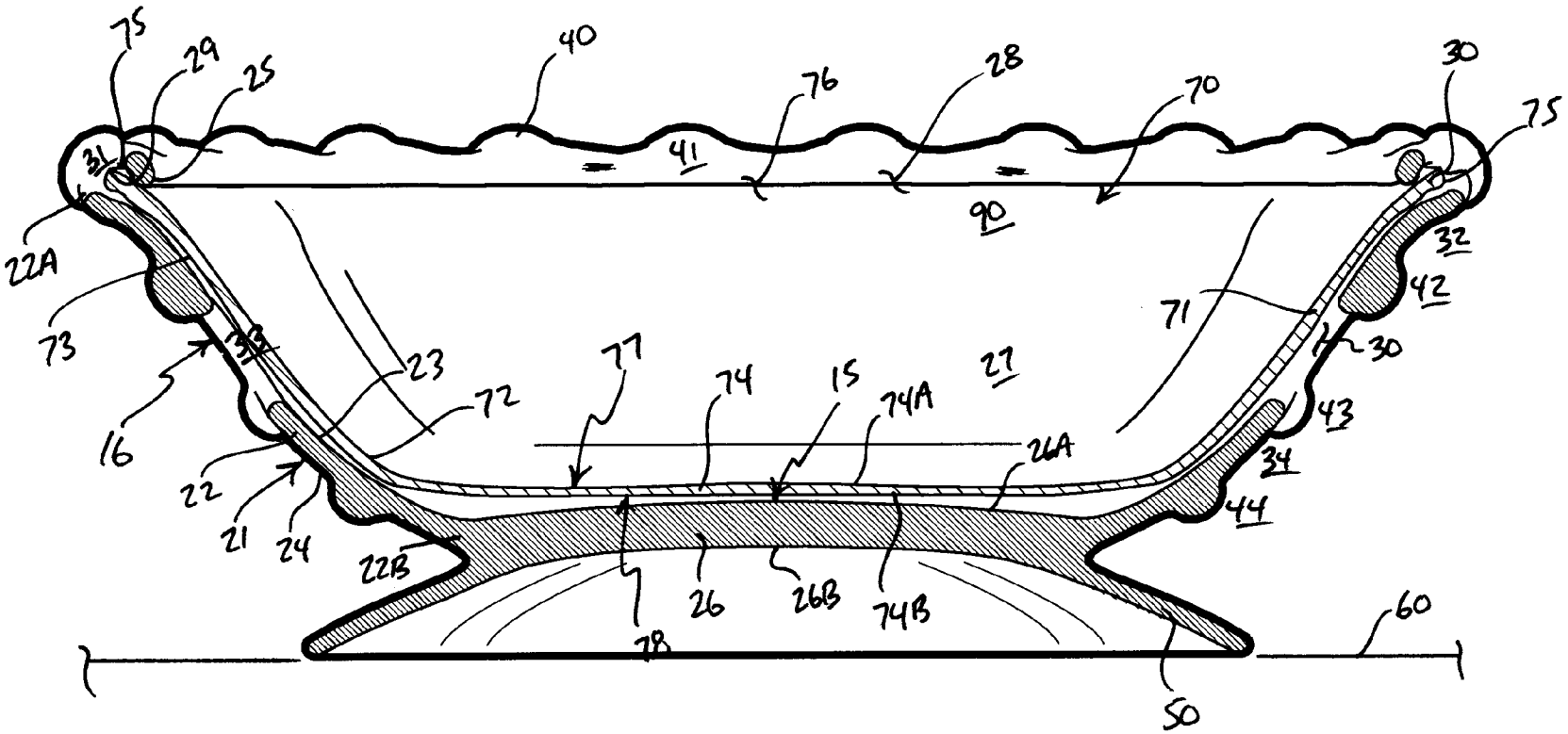
FIG. 10 is a sectional view taken along line 10-10 of FIG. 9.

Referencing FIGS. 5, 7, and 10, suction cup 50 is used to secure container wrap 20 to a surface 60, such as the surface of a table, high chair tray, or other selected substantially horizontal, flat surface. Suction cup 50 is broad and circular in shape, is quite large, and is somewhat greater in overall diameter with respect to the diameter of bottom 26 and is somewhat lesser in overall diameter with respect to the diameter of upper end 22A of sidewall 22, and is formed in lower end 22B of sidewall 22 and bottom 26. Suction cup 50 opposes outer surface 26B of bottom 26, projects outwardly and away from bottom 26 opposite with respect to sidewall 22, and sticks through suction in a conventional as with a conventional suction cup to a smooth, nonporous surface to secure or otherwise attach container wrap 20 to such smooth, nonporous surface, such as surface 60 denoted in FIGS. 5, 7, and 10. Suction cup 50 opposes opening 27 encircled by parametric edge 25 and groove 29 formed in upper end 22A of sidewall 22 and is centrally located with respect to opening 27. As such, continuous sidewall 22 is positioned and supported atop suction cup 50 and surface 60 to which suction cup 50 is secured, as clearly illustrated in FIGS. 7 and 10, such that sidewall 22 projects upright with respect to surface 60 and suction cup 50 from lower end 22B to upper end 22A.

Figure 8:
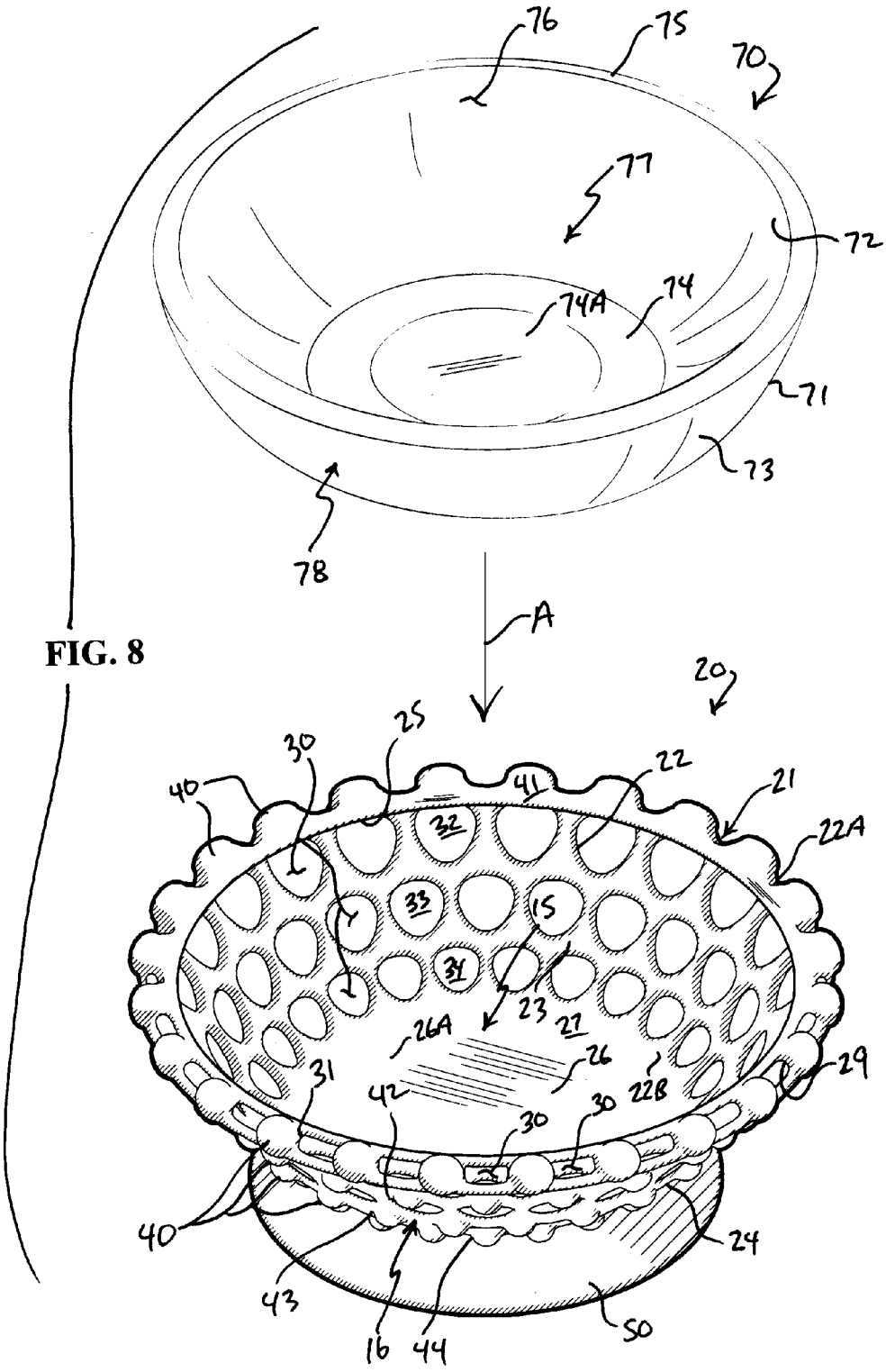
FIG. 8 is a perspective view of the container wrap of FIG. 1 and a breakable container opposite to the container wrap in preparation for installation with the container wrap.

Container wrap 20 constructed and arranged to be wrapped about a breakable container, such as breakable container 70 illustrated in FIG. 8, to prevent breakage of the breakable container and yet which leaves breakable container available to be used in accordance with its intended or normal use without obstruction or interference. Breakable container 70 is a form of dishware, and is made of earthenware, stoneware, porcelain, glass, or other like material that is easily broken, such as when dropped on a floor or other hard surface, and consists of a continuous sidewall 71 having an inner surface 72 and an opposed outer surface 73 that meet at a closed bottom 74 and an opposed parametric edge 75 encircling a container opening 76 to inner surface 73 and closed bottom 74. Closed bottom 74 is integral with sidewall 71, and has an inner surface 74A that is contiguous with inner surface 72 of sidewall 71. Inner surface 72 of sidewall 71 and inner surface 74A of closed bottom 74 cooperate together to form an inner face of container 70 denoted generally at 77, which is generally concave in shape and which is recessed with respect to parametric edge 75 forming a receiving area 76A in container 70. The inner face of container 70 formed by inner surface 72 of sidewall 71 and inner surface 74A of closed bottom 74 is to receive and hold food for eating, or other material. Furthermore, Opening 76 leads to receiving area 76A bound by the inner face of container 70. Outer surface 73 of sidewall 71 and outer surface 74B of closed bottom 74 cooperate together to form an outer face of container 70 denoted generally at 78, which is generally concave in shape. Container 70 is exemplary of a bowl in the present embodiment, and may be formed in the shape of a like or similar container, such as a dinner plate, salad plate, or the like having structural components substantially common to that of container 70. Plates have the same structural components as bowls, but are, of course, broader and flatter compared to bowls.

According to the principle of the invention, container wrap 20 is a device used to prevent breakage of a breakable container, such as breakable container 70. Referencing FIG. 10, container wrap 20 is constructed to be applied, namely, wrapped, over and across outer face 78 and parametric edge 75 of breakable container 70, such that openwork 21 of the shock resistant material containing numerous openings 30 in the pattern is to extend across outer face 78 and parametric edge 75 of breakable container 70, and numerous protuberances 40 in the pattern of openwork 21 are to project outward with respect to outer face 78 and parametric edge 75 of breakable container 70. With respect to openwork 21, openings 30 and protuberances 40 of openwork 21 cooperate to absorb and dissipate impacting forces to prevent breakage of breakable container 70, and suction cup 50 formed in bottom 26 of container wrap 20 also functions to absorb and dissipate impacting forces to prevent breakage of breakable container 50. Of course, the shock resistant material of openwork 21 is flexible and stretchable to permit openwork 21 of the shock resistant material to be flexibly and stretchably applied/wrapped to outer surface 78 and parametric edge 75 of breakable container 70. Installation of container 70 with respect to container wrap 20 will now be discussed in conjunction with FIGS. 9 and 10.

Figure 9:
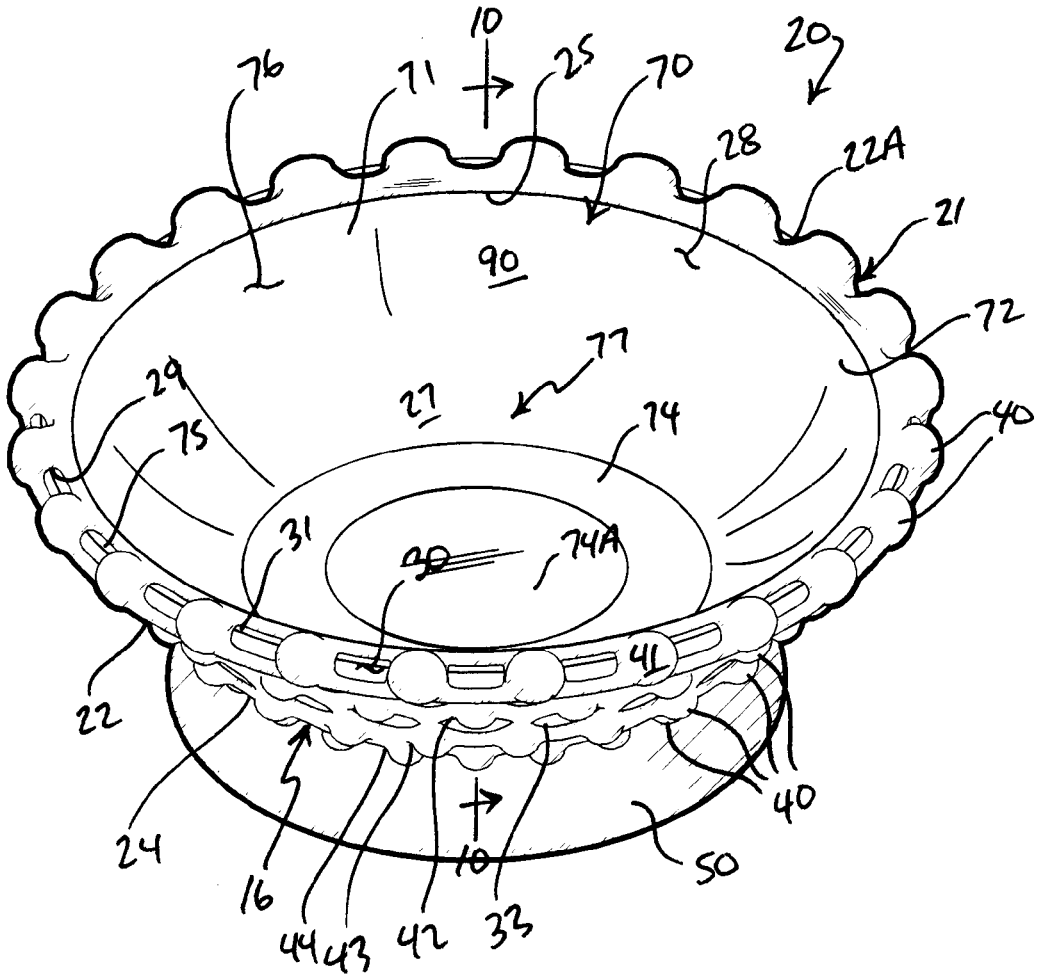
FIG. 9 is a perspective view of the breakable container of FIG. 8 installed with the container wrap of FIG. 1 forming a container assembly in accordance with the principle of the invention.

To install container 40 with respect to container wrap 20 in reference to FIG. 9, container 70 is taken up, such as by hand, and is maneuvered in opposition to container wrap 20 to position and register outer face 78 of container 70 with inner face 15 of container wrap 20. At this point, container 70 is maneuvered toward inner face 15 of container wrap 20 in the direction indicated by the arrowed line A in FIG. 9 to bring container 70 and container wrap 20 together, and container 70 is passed into depression or receiving area 27 through opening 28 and outer face 78 of container 70 is applied onto and against inner face 15 of container wrap 20 to thereby initially apply container wrap 20 to container 70. Container 70 comparable in size with respect to the size of depression or receiving area 27 of container wrap 20, and is thus sized to be received by depression or receiving area 27. To complete the installation of container 70 with respect to container wrap 20 as illustrated in FIGS. 9 and 10, openwork 21 is flexed and stretched, such as by hand, to wrap container wrap 20 about outer face 78 of container and to draw upper end 22A of sidewall 22 of container wrap 20 over and across parametric edge 75 of container 70 to apply and locate parametric edge 75 into groove 29 formed in upper end 22A of container wrap 20. FIGS. 9 and 10 illustrate container 70 installed with respect to container wrap 20, and it is to be understood that the installation of container 70 with container wrap 20 forms a container assembly 90 constructed and arranged in accordance with the principle of the invention. So installed with respect to container wrap 20, container wrap 20 is wrapped about container 70 and secures container 70 and tightly embraces container 70, in which this wrapping of container wrap 20 about outer face 78 and parametric edge 75 of container 70 and the installation of parametric edge 75 of container 70 in groove 29 serves to tightly embrace container 70 and hold container 70 in place preventing container 70 from inadvertently detaching from container wrap 20. In FIG. 10 there is an exaggerated separation between container 70 and container wrap 20, and this is set forth for illustrative purposes only with the understanding that container wrap 20 when wrapped about container 70 to form container assembly 90 tightly embraces container 70. To remove container 70 from container wrap 20, container wrap 20 is peeled away from container 70 simply by reversing the above-described steps of installing container 70 with respect to container wrap 20.

After applying container 70 to container wrap 20, container assembly 90 is formed, in accordance with the principle of the invention. In container assembly 90 illustrated in FIG. 10, container wrap 20 extends over and across outer face 78 and parametric edge 75 of container 70, in which inner surface 23 of openwork 21 extends over and across parametric edge 75 of container 70 and outer surface 73 of outer face 78 of container 70, and inner surface 26A of bottom 26 of container wrap 20 extends over and across outer surface 74B of outer face 78 of container 70, and inner face 77 of container 70 is left unobstructed by container wrap 20 and may thus be used in accordance with its intended or normal use without obstruction or interference by container wrap 20, in accordance with the principle of the invention. Suction cup 50 formed in container wrap 20 extends outwardly from outer surface 26B of bottom 26 and outwardly with respect to outer surface 74B of closed bottom 74 of container 70.

Openings 30 of openwork 21 extend across outer surface 73 of outer face 78 of container 70 and parametric edge 75 of container 70, and protuberances 40 of openwork 21 project outward from outer surface 24 of outer face 16 of container wrap 20 and thus outward with respect to outer surface 73 of outer face 78 of container 70 and parametric edge 75 of container 70, and are free and available to take on the brunt impacting forces to prevent container 70 from breaking, such as if dropped. Openings 30 in openwork 21 and protuberances 40 in openwork 21 cooperate to absorb and dissipate impacting forces to prevent breakage of breakable container 70. The shock absorbing material forming protuberances 40 allows protuberances 40 to absorb and dissipate impact forces, and openings 30 in sidewall 22 that characterize and form openwork 21 allow protuberances 40 to displace with respect to openwork 21, which contributes to the shock absorption ability of protuberances 40 and openwork 21 further providing the shock absorbing characteristic of openwork 21. Suction cup 50 formed in container wrap 20 extend outwardly from outer surface 26B of bottom 26 and outwardly with respect to outer surface 74B of closed bottom 74 of container 70 is also able to take on the brunt of impacting forces and is able to absorb and dissipate such impacting forces to prevent breakage of container 70.

Considering the pattern of openings 30 and the pattern of protuberances 40 of container wrap 20 with respect to container 70 of container assembly 90 illustrated in FIG. 10, concurrent rows 31 and 41 of openings 30 and protuberances 40 respectively, at and opposing groove 29 form a row of alternating openings 30 and protuberances 40 as previously explained, which extends over and across parametric edge 75 of container 70, such that protuberances 40 of row 41 extend outwardly from outer surface 24 of sidewall 22 of container wrap 20 and outward with respect to parametric edge 75 of container 70. Fields or rows 32-34 of openings 30 and fields or rows 42-44 alternating along sidewall 22 between upper end 22A of sidewall 22 lower end 22B of sidewall 22 extend along outer surface 73 of outer face 78 of container from proximate to parametric edge 75 of container 70 to closed bottom 74 of container 70. The row of alternating openings 30 and protuberances 40 formed by row 31 of openings and row 41 of protuberances extending over and across parametric edge 75 of container 70 is parallel with respect to parametric edge 75 of container, and rows 32-34 of openings 30 and rows 42-44 alternating along sidewall 22 between upper end 22A of sidewall 22 lower end 22B of sidewall 22 that extend along outer surface 73 of outer face 78 of container from proximate to parametric edge 75 of container 70 to closed bottom 74 of container 70 are each also parallel with respect not only to each other and to the row of alternating openings 30 and protuberances 40 formed by row 31 of openings and row 41 of protuberances at parametric edge 75 of container 70, but also to parametric edge 75 of container 70.

After installing container 70 with respect to container wrap 20 to form container assembly 90 in FIGS. 9 and 10, suction cup 50 may be applied to and pressed against a surface, such as surface 60 in FIG. 10, to secure container wrap 20, and container 70 held by container wrap 20, with respect to surface 60, such that sidewall 22 projects upright with respect to surface 60 from lower end 22B to upper end 22A and container 70 held by container wrap 20 is supported upright with respect to surface 60 from bottom 74 to parametric edge 75 leaving inner face 77 of container 70 open and exposed in preparation for use in taking on food for serving and feeding without obstruction or interference by container wrap 20. And so at this point container 70 may be used on accordance with its intended use, such as to receive and serve food, such as to a baby or small child. With suction cup 50 securing container wrap and container 70 held by container wrap 20 with respect to surface 60, container assembly 90 kept in place and is not easily dislodged by a baby or small child eating from container 70. However, in the event container assembly 90 becomes dislodged and falls to the floor, for instance, the shock absorbing characteristics of container wrap 20 as provided by openwork 21 and suction cup 50 as herein described prevent container 70 from breaking, in accordance with the principle of the invention. After use of container 70 in serving food is complete, container assembly 90 may be pulled away from surface 60 to detach suction cup 50 from surface 60 to detach container assembly 90 from surface 60, container wrap 20 may then be peeled away from container 70, and container wrap 20 and container 70 may then be cleaned in preparation for another use or for storage.

Those having regard for the art will readily appreciate that an exemplary and highly useful container wrap 20 is disclosed that in use is applied to a breakable container, such as breakable container 70, to prevent breakage of breakable container 70 and yet which leaves breakable container 70 available to be used in accordance with its intended or normal use without obstruction or interference. Container wrap 20 is flexible and stretchable, and includes stretchable and flexible mesh or openwork 21 that wraps easily over a breakable container, such as breakable container 70. Suction cup 50 incorporated in bottom 26 of container wrap 20 is used to secure container wrap 20 in place to a surface through suction, keeps container 70 installed with respect to container wrap 20 forming container assembly 90 in place, and absorbs and dissipates impacting forces to keep the breakable container from breaking, such as if dropped. Container wrap 20 may be shaped and designed to fit any breakable bowl or dish having structural characteristics substantially common to that of container 70. Container wrap 20 protects breakable containers from breaking, and thus provides a way for parents to serve food to babies and young children in breakable containers other than plastic containers that leach harmful chemicals, and eliminates the need for parents to purchase separate, plastic dishware specifically designed for use in feeding babies and small children. In the preferred embodiment herein disclosed, container wrap 20 is formed with one suction cup, namely, suction cup 50. If desired, container wrap 20 may be formed with a plurality of suction cups to secure container wrap 20 in place through suction to a surface.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A device comprising:

a wrap including a sidewall having a plurality of openings, the wrap configured to extend over and across an outer surface and an edge of a container; and at least one suction cup formed in the wrap to detachably secure the wrap and the container to a surface;

wherein the wrap is formed of a shock resistant material to absorb and dissipate impacting forces to prevent breakage of the container; and wherein the container includes an inner surface that remains substantially unobstructed by the wrap.

2. The device according to claim 1, further comprising:

the shock resistant material of the wrap is flexible and stretchable; and the wrap flexibly and stretchably conforms to the outer surface and the edge of the container.

3. The device according to claim 2, further comprising numerous shock resistant protuberances formed in the shock resistant material of the wrap and extending across and projecting outward.

4. The device according to claim 3 wherein the plurality of openings in the sidewall of the wrap and the protuberances cooperate such that the openings and the protuberances dissipate impacting forces.

5. The device according to claim 4, wherein the openings are arranged in spaced apart continuous rows of the openings parallel with respect to the edge of the container.

6. The device according to claim 5, wherein the openings of each of the continuous rows of the openings are substantially equal in size.

7. The device according to claim 6, wherein the openings of each of the continuous rows of the openings are substantially equally spaced apart.

8. The device according to claim 7, wherein the protuberances are arranged in spaced apart continuous rows of the protuberances parallel with respect to the edge of the container and the continuous rows of the openings.

9. The device according to claim 8, wherein the protuberances of each of the continuous rows of the protuberances are substantially equal in size.

10. The device according to claim 9, wherein the protuberances of each of the continuous rows of the protuberances are substantially equally spaced apart.

11. A device to prevent breakage of a breakable container formed with an outer face and an opposed inner face that meet at a parametric edge encircling a container opening to the inner face of the breakable container, the inner face of the breakable container being recessed with respect to the parametric edge and the container opening, the device comprising:

a container wrap formed of a shock resistant material;

the container wrap configured to be applied over and across the outer face and the parametric edge of the breakable container to absorb and dissipate impacting forces to prevent breakage of the breakable container; and at least one suction cup formed in the container wrap to detachably secure the container wrap to a surface.

12. The device according to claim 11, wherein the shock resistant material is flexible and stretchable to permit the container wrap to be flexibly and stretchably applied to the outer surface and the parametric edge of the breakable container.

13. The device according to claim 12, further comprising numerous shock resistant protuberances formed in the shock resistant material to project outward with respect to the outer face and the parametric edge of the breakable container.

14. The device according to claim 13, further comprising an openwork of the shock resistant material formed in the container wrap, the openwork containing numerous openings to extend across the outer face and the parametric edge of the breakable container and formed with the protuberances.

15. The device according to claim 14, wherein the openings are arranged in spaced apart continuous parallel rows of the openings.

16. The device according to claim 15, wherein the openings of each of the continuous parallel rows of the openings are substantially equal in size.

17. The device according to claim 16, wherein the openings of each of the continuous parallel rows of the openings are substantially equally spaced apart.

18. The device according to claim 17, wherein the protuberances are arranged in spaced apart continuous parallel rows of the protuberances parallel with respect to the continuous parallel rows of the openings.

19. The device according to claim 18, wherein the protuberances of each of the continuous parallel rows of the protuberances are substantially equal in size.

20. The device according to claim 19, wherein the protuberances of each of the continuous parallel rows of the protuberances are substantially equally spaced apart.

21. A method comprising the steps of:

providing a wrap including a sidewall having a plurality of openings, the wrap;

formed of a shock resistant material; and applying the wrap over and across an outer surface and an edge of a container leaving a substantial portion of an inner surface of the container unobstructed by the wrap to permit use of the inner portion of the container without obstruction or interference by the wrap.

22. The method according to claim 21, wherein the shock resistant material of the wrap is flexible and stretchable, and the step of applying the wrap over and across the outer surface and the edge of the container further comprises flexing and stretching the wrap over and across the outer surface and the edge of the container.

23. The method according to claim 22, further comprising detachably securing the wrap to a surface to detachably secure the container with respect to the surface.

24. The method according to claim 23, wherein the step of detachably securing the wrap to the surface to detachably secure the container with respect to the surface comprises: providing the wrap with at least one suction cup; and applying the suction cup to the surface.

* * * * *